US010487503B2

(12) United States Patent
White et al.

(10) Patent No.: US 10,487,503 B2
(45) Date of Patent: Nov. 26, 2019

(54) LIGHTING ASSEMBLY

(71) Applicant: CertainTeed Canada, Inc., Toronto (CA)

(72) Inventors: Ronald White, Holland Landing (CA); Martin Daniel Gerkes, Toronto (CA)

(73) Assignee: CertainTeed Canada, Inc., Toronto (CA)

( * ) Notice: Subject to any disclaimer, the term of this patent is extended or adjusted under 35 U.S.C. 154(b) by 0 days.

(21) Appl. No.: 16/003,879

(22) Filed: Jun. 8, 2018

(65) Prior Publication Data

US 2018/0291621 A1 Oct. 11, 2018

Related U.S. Application Data

(63) Continuation of application No. 15/388,354, filed on Dec. 22, 2016, now Pat. No. 10,011,986, which is a continuation of application No. 14/827,845, filed on Aug. 17, 2015, now Pat. No. 9,534,382, which is a continuation of application No. PCT/CA2015/000414, filed on Jun. 26, 2015.

(30) Foreign Application Priority Data

Jul. 16, 2014 (CA) ..... 2857004

(51) Int. Cl.

| | |
|---|---|
| ***E04B 9/00*** | (2006.01) |
| ***F21S 8/02*** | (2006.01) |
| ***F21S 4/28*** | (2016.01) |
| ***F21V 21/02*** | (2006.01) |
| ***F21S 8/04*** | (2006.01) |
| *F21Y 115/10* | (2016.01) |
| *F21V 29/74* | (2015.01) |

(52) U.S. Cl.

CPC ..... *E04B 9/006* (2013.01); *F21S 4/28* (2016.01); *F21S 8/026* (2013.01); *F21S 8/04* (2013.01); *F21V 21/025* (2013.01); *F21V 29/74* (2015.01); *F21Y 2115/10* (2016.08)

(58) Field of Classification Search

CPC ..... E04B 9/006; F21S 8/04; F21S 4/28; F21S 8/026; F21V 21/025

See application file for complete search history.

(56) References Cited

U.S. PATENT DOCUMENTS

2011/0297971 A1* 12/2011 Shimizu ..... F21S 8/04 257/88

* cited by examiner

*Primary Examiner* — Andrew J Triggs
(74) *Attorney, Agent, or Firm* — McDonnell Boehnen Hulbert & Berghoff LLP

(57) ABSTRACT

A lighting system for ceiling grid systems advantageously uses a grid member designed to cooperate with a strip light to secure the strip light generally aligned beneath the grid system. The grid system can be initially installed with the cooperating grid members at specified locations. The strip lights can then be installed to the grid system. This arrangement simplifies installation particularly installations in commercial type spaces and larger scale architectural projects.

19 Claims, 7 Drawing Sheets

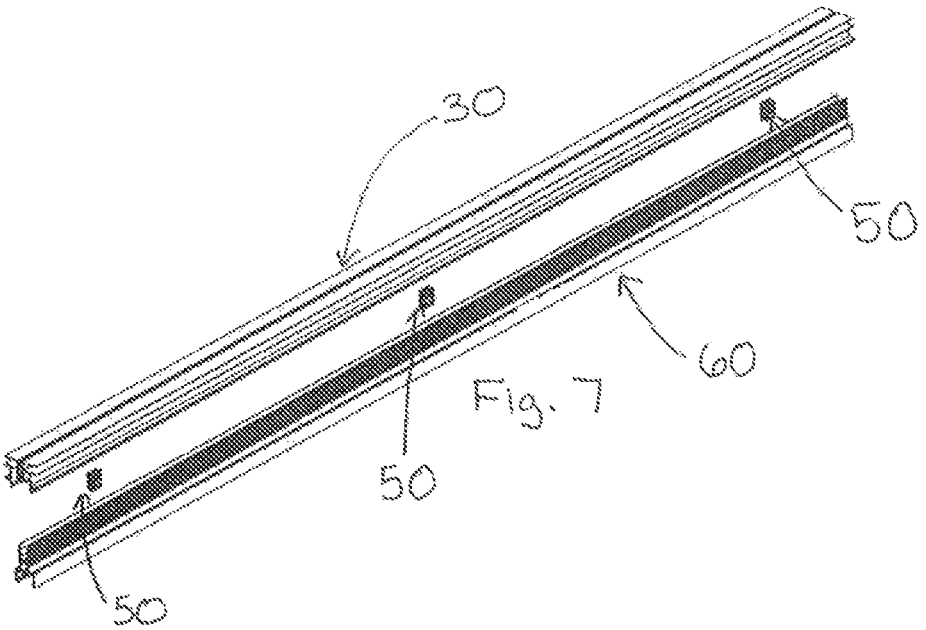
Fig. 7
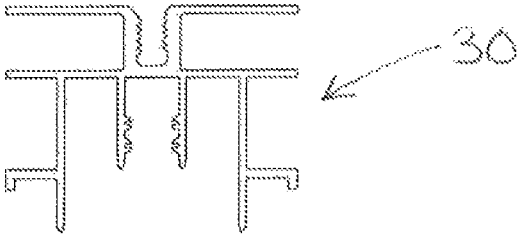
Fig. 8
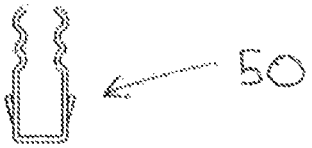
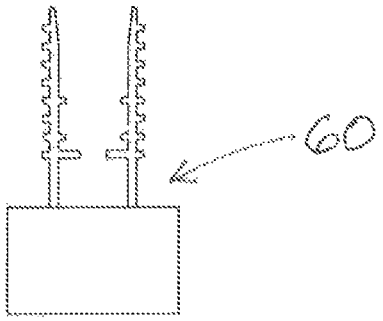

LIGHTING ASSEMBLY

This application is a continuation of U.S. patent application Ser. No. 15/388,354, filed Dec. 22, 2016, which is a continuation of U.S. patent application Ser. No. 14/827,845, filed on Aug. 17, 2015, which is a continuation of International Patent Application PCT/CA2015/000414 filed on Jun. 26, 2015 that claims the benefit of priority of Canadian application SN 2,857,004, filed on Jul. 16, 2014. Each of the above-referenced applications is hereby incorporated herein by reference in its entirety.

FIELD OF THE INVENTION

The present invention relates to strip lighting, and in particular relates to strip lighting for use in association with grid type ceiling systems.

BACKGROUND OF THE INVENTION

Low voltage lighting systems have gained substantial acceptance in the market place and narrow profile elongate strip lighting has been used in association with ceiling grid systems. The actual strip lighting is often a series of light-emitting diodes (LEDs) located in a common housing.

In one known prior art arrangement the actual strip light is a cross member of a T-bar grid system. The strip light is an integral component of the T-bar grid member and the lamp is selectively connected to a low voltage driver arrangement provided above the ceiling.

There remains a need to provide a system that allows selective securement of strip lighting to a ceiling grid system where the ceiling grid system is installed in a conventional manner and strip lighting is secured to the grid system.

For many large scale commercial type applications, grid ceiling systems are initially installed by personnel who are not directly responsible or qualified with respect to the installation of electrical systems. The ceiling system is typically designed to allow light fixtures to be installed by electricians etc. after installation of the grid system. There remains a need to provide a system that allows strip lighting to be installed in such a conventional manner.

SUMMARY OF THE INVENTION

The present invention provides a releasable securing system where strip lighting cooperates with a structural member of the grid ceiling system. Specialized grid members are used in association with concealed type ceiling paneling systems or traditional T-bar type systems. The present design utilizes a releasable connection of a separate strip light housing to the grid member whereby the strip lighting is installed after the grid system has been put in place and is an integrated component of the ceiling system.

The ceiling grid system according to the present invention receives an LED strip light and the system comprises a series of connected grid members for supporting and securing the peripheral edge of ceiling panels aligned with the grid system. At least some of the grid members have a downwardly opening recess that extends in the length of the grid member and the downwardly opening recess releasably engages and secures an LED strip light such that the strip light is exposed on a lower surface of the grid network.

BRIEF DESCRIPTION OF THE DRAWINGS

Preferred embodiments of the invention are shown in the drawings, wherein:

FIG. 7 is a partial exploded view showing an LED strip light about to receive three spring clips in combination with a cross member of a grid system designed to releasably support the LED strip light;

FIG. 8 is an end view of a cross member, a spring clip and a strip light aligned beneath the cross member;

DETAILED DESCRIPTION OF THE PREFERRED EMBODIMENTS

Figure 1:
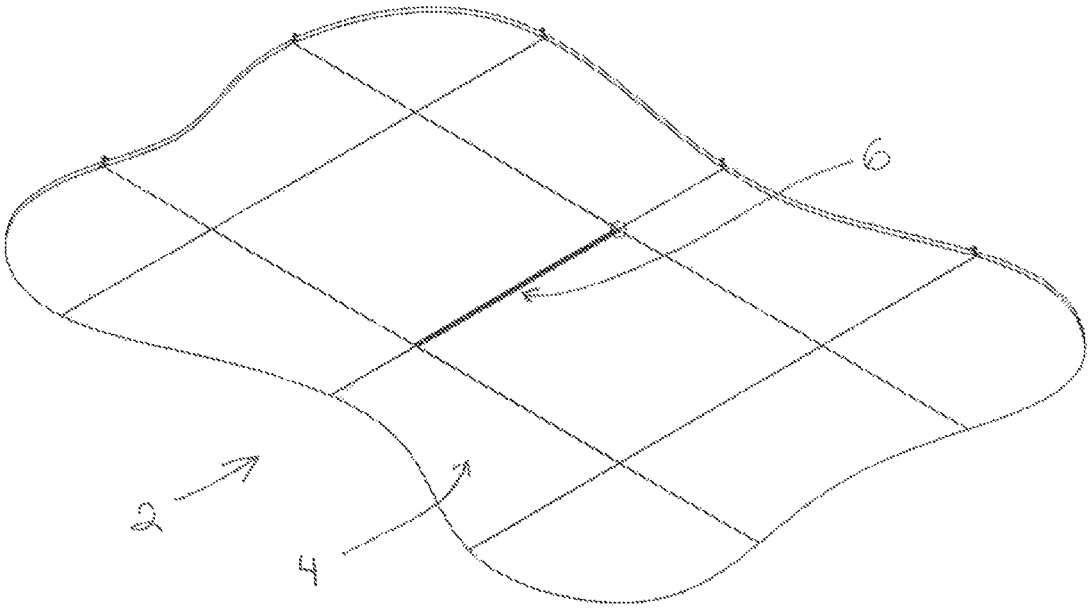
FIG. 1 is a partial perspective view of a ceiling grid system with one strip light exposed on a lower surface of the ceiling.
Figure 2:
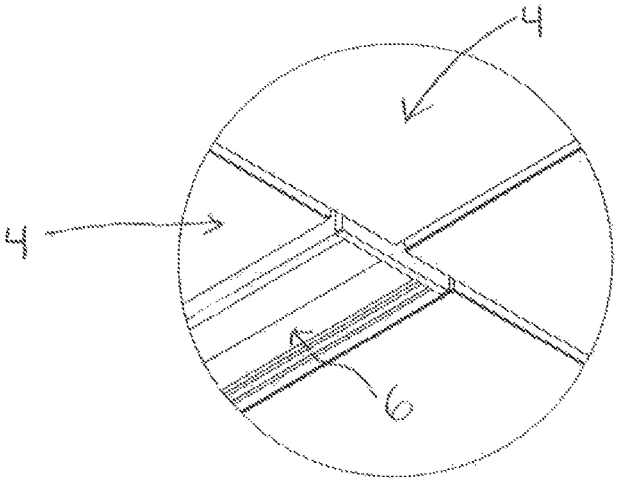
FIG. 2 is a partial perspective view showing the end section of a secured strip light and four adjacent panels of the ceiling grid system.
Figure 3:
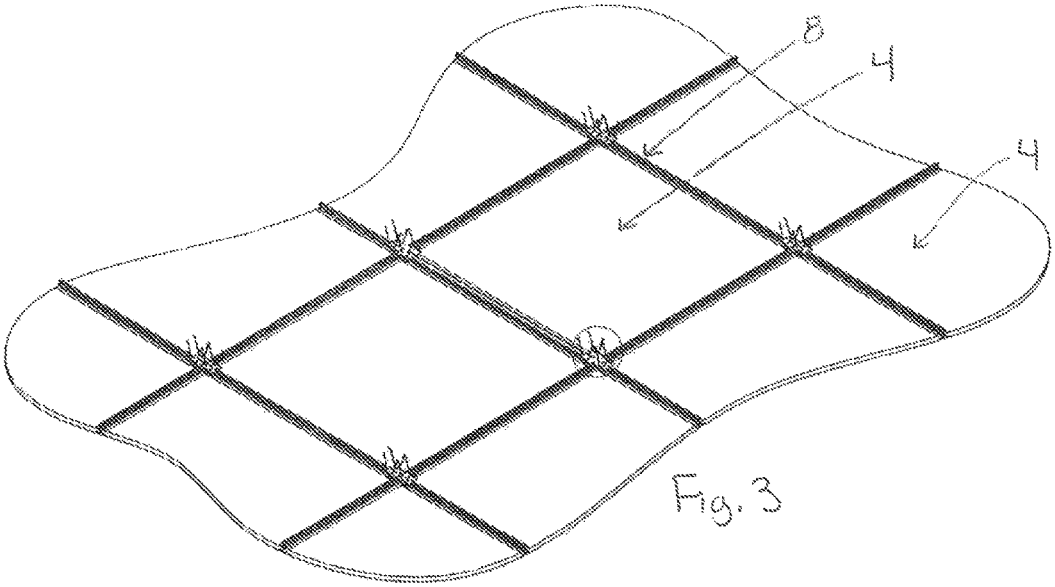
FIG. 3 is a top view of the ceiling system of FIG. 1.

The ceiling grid paneling system 2 shown in FIGS. 1 and 3 includes a series of secured ceiling panels 4, a grid system 8 having a series of grid connection nodes 10 and a LED strip light 6 secured beneath one of the cross grid members and abutting two ceiling panels. Details of the LED strip light 6 and its relationship to the adjacent panels is shown in FIG. 2. It is preferred that the LED strip light in this case projects marginally below the lower surface of the ceiling panels. A large portion of the LED housing is hidden by the adjacent ceiling panels. The LED strip light 6 does have a certain width and therefore the two abutting adjacent panels have been cut down in size to accommodate the LED strip light.

In FIG. 3 it can be seen that the grid system 8 is exposed and in this embodiment, the ceiling grid paneling system is a concealed grid system where the grid members are hidden by the ceiling panels suspended below the grid system. Such a concealed ceiling panel grid system is in contrast to the traditional T-bar type ceiling grid system where the grid members are exposed and form part of the lower surface of the ceiling. The present system of securing the LED strip light to a grid member can also be adapted for securement to a specialized cross member of a T-bar grid system. In this case the lower edge of the strip light 6 preferably would project slightly below the lower surface of the ceiling panels.

Figure 4:
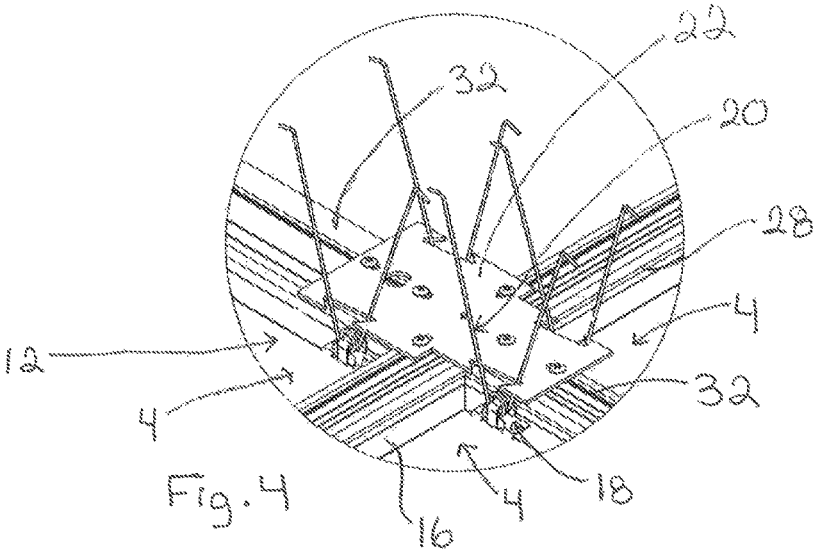
FIG. 4 is a partial perspective view showing the end section of two cross members of the grid supported on a main grid member.

In the preferred ceiling grid paneling system as shown in FIG. 4, the individual ceiling panels 4 have a series of panel clips that engage the lower surface of the ceiling panel, and in combination with connection torsion springs, engage the top connecting plate 22 to suspend the panels beneath the grid system. The top connecting plate 22 includes a series of slots for receiving the arms of the torsion spring and the connecting plate also includes a series of ports that receive mechanical screws which engage receiving channels in the connecting members. In this way the grid members are connected via the top connecting plate and maintained in accurate alignment. Typically there is a main grid member, in this case shown as 28, and conventional cross grid members 32 extend between adjacent main grid members. For the strip light the conventional cross grid members are preferably replaced with the modified cross grid member 30.

Figure 5:
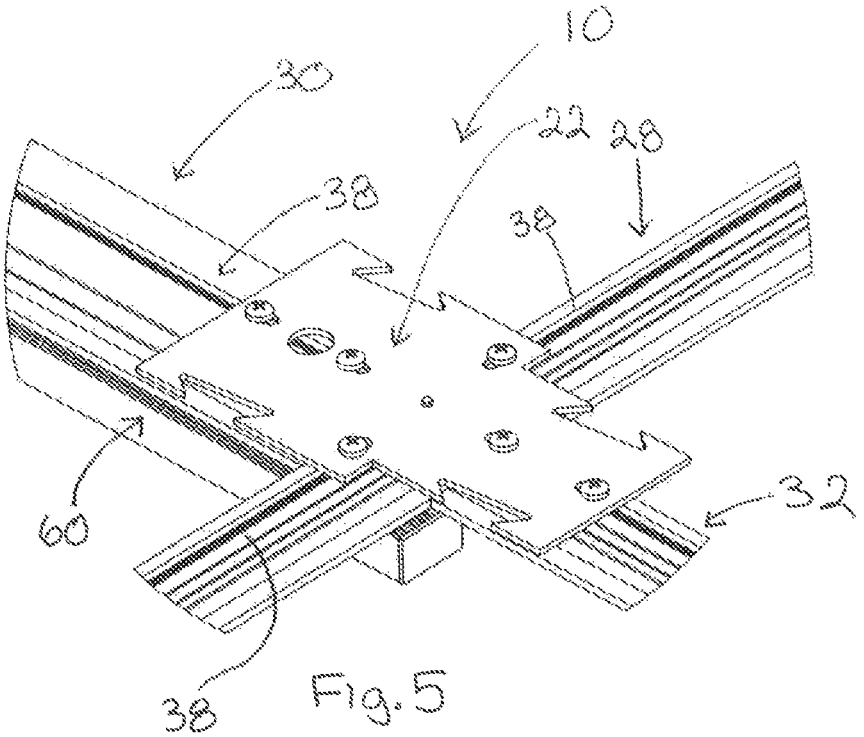
FIG. 5 is a partial perspective view of a main grid member with one of the cross members having an LED light secured thereto.
Figure 6:
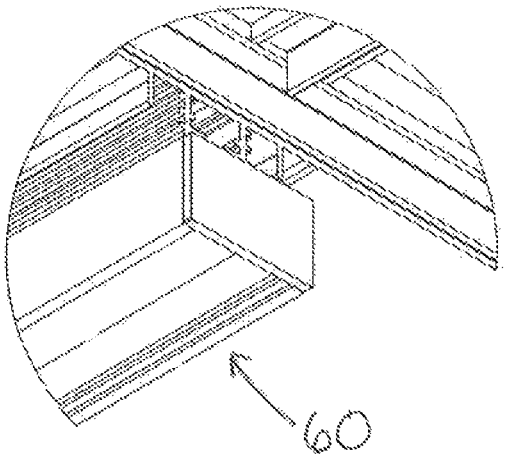
FIG. 6 is a further perspective view showing an LED strip light secured beneath a cross member.

The partial perspective view of FIG. 5 shows a connection node 10 where the top connecting plate 22 is secured to a modified cross grid member 30 that is adapted to releasably engage an LED lamp housing 60. The LED lamp housing 60 is aligned beneath the modified cross grid member 30. The top portion of the modified cross grid member 30 engages the top connecting plate 22 in the same manner as the other grid members. In FIG. 6 it can be seen that the lamp housing 60 projects downwardly from the grid system and this additional distance is selected to be appropriate according to whether this is a suspended paneling ceiling system as shown in the earlier drawings or for a different type of paneling system such as a T-bar system.

FIGS. 7 and 8 show details of the cooperation of the modified cross member 30, the lamp housing 60 and a spring clip 50 that engages the lamp housing and allows for releasable securement of the lamp housing beneath the modified grid member.

The spring clips 50 as shown in FIG. 7 are positioned at appropriate positions along the length of the lamp housing 60 and are received in a securing recess 62 of the lamp housing. The spring clip 50 is preferably of a spring steel and is inserted downwardly into the securing recess 62 and is held in the recess by means of the retaining tabs 54 of the spring clip. Basically, as the spring clip 50 is forced into the securing recess 62 the tabs 54 bend inwardly and will cam past the retaining stub arms 64 which project into the securing recess 62. The base 56 of the spring clip will bottom out on and be supported on the base arms 68 that also extend into the securing recess. The securing recess is defined either side thereof by the limiting arms 66. As shown, the spring clip 50 includes its own spring arms 52 with an undulating surface for engaging securing projections of the retaining arms 36 of the modified cross member 30.

Figures 9, 10:
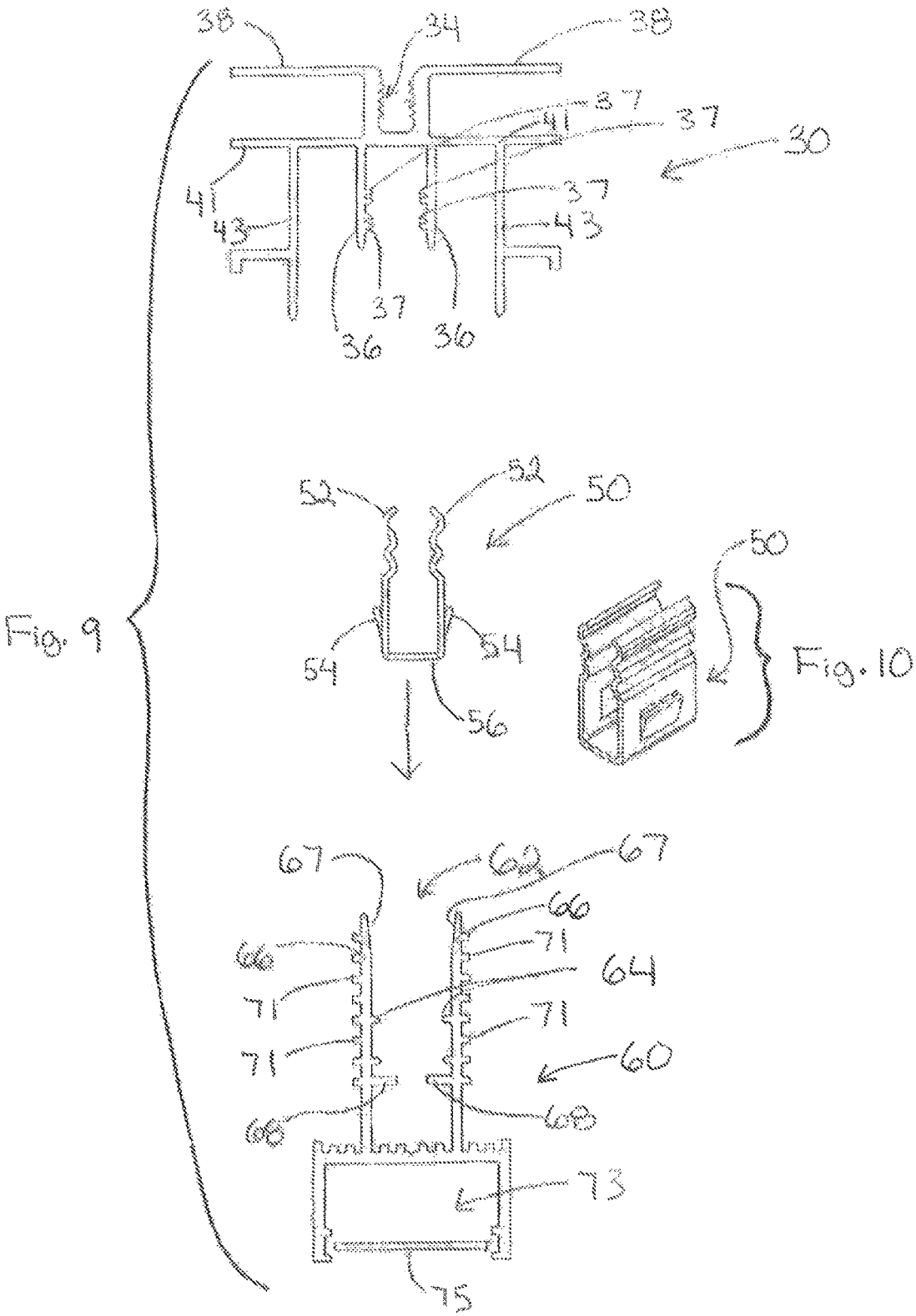
FIG. 9 is a further exploded view of the cross member, the spring clip and a lamp extrusion member that will receive LED lamps.
FIG. 10 is a perspective view of the spring clip.

FIG. 8 shows details of the modified cross member 30, the spring clips 50 and the preferred lamp housing 60. FIG. 9 shows additional details of these components and their particular cooperation.

The modified cross member 30 as shown in FIG. 5 has a top surface that is designed to allow attachment to the top connecting plate 22 which is used to connect four grid members at an intersection. The modified cross member 30 includes a pair of aligned upper flanges 38 positioned to opposite sides of the securing recess 34. As shown in FIG. 5, the securing recess 34 is used to allow convenient attachment to the connecting plate 22.

The spring clip 50 is adapted to be received within the lamp housing 60 and this spring clip will allow the combined lamp housing and spring clip 50 to releasably engage the modified cross member 30.

Returning to the modified cross member 30, it can be seen that it includes lower flanges 41 which extend outwardly and are generally parallel to the upper flanges 38. Each of the lower flanges 41 include equal length downwardly extending positioning arms 43 that are centered either side of and exterior to the retaining arms 36. The retaining arms 36 include inwardly extending securing projections 37 that cooperate with the spring arms 52 of the spring clip 50. The spring arms 52, when the lamp housing 60 is brought into engagement with the combined modified cross member 30 and spring clip 50, engage the cavity between the retaining arms 36 and the securing projections 37 engage indentations in the spring arms 52.

Figure 12:
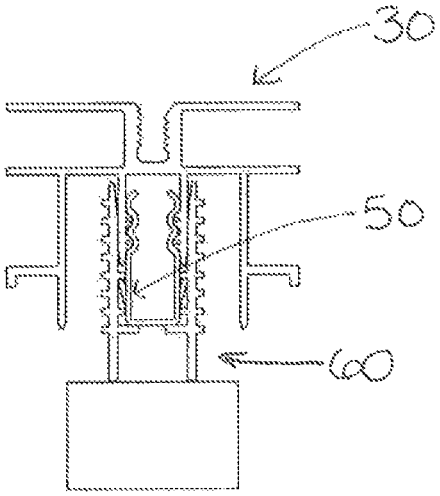
FIG. 12 is a sectional view showing the cross member and the lamp with spring clips secured thereto.
Figure 13:
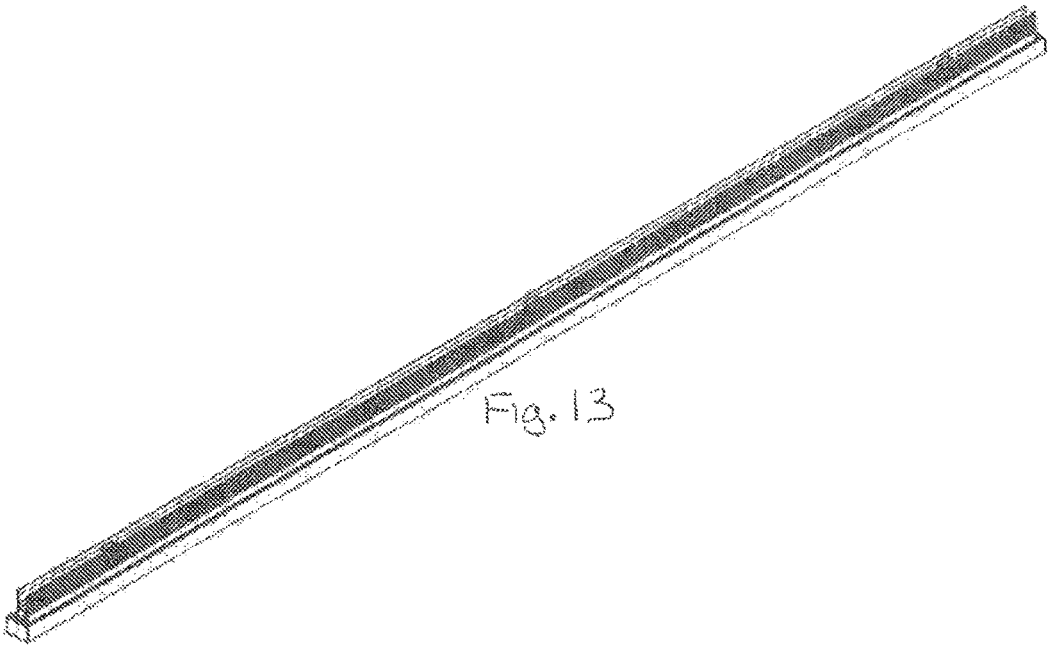
FIG. 13 is a perspective view of the strip light.

The lamp housing 60 includes a securing recess 62 that receives the spring clip 50. The spring clip 50 as shown in FIG. 12 has the base 56 of the spring clip in engagement with base arms 68 of the lamp housing 60 and these base arms extend into the securing recess 62. The securing recess 62 above the base arms 68 include inwardly projecting stub arms 64 which cooperate with retaining tabs 54 of the spring clip 50 to maintain the spring clip 50 in the securing recess 62. In this way the spring clip 50 is retained in the securing recess 62 and the spring clip will allow releasable attachment of the lamp housing 60 to the retaining arms 36 of the modified cross member 30.

Figure 14:
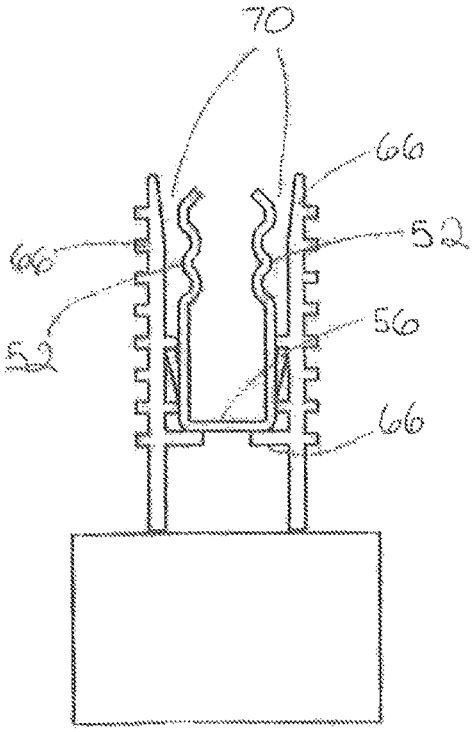
FIG. 14 is an end view of the strip light with a received securing clip.

As shown in FIG. 14, with the spring clip 50 received in the securing recess 62, the spring arms 52 are spaced inwardly of the limiting arms 66 and form a gap 70 that will receive the retaining arms 36 of the modified cross member 30.

It can also be seen in FIG. 9 that the free ends of the limiting arms 66 each have an angled cam surface 67 for assistance in receiving the rotating arms 36 of the modified cross member 30. The exterior of the limiting arms 66 include short fin type cooling extensions 71 for assistance in heat transfer to the air exterior to the lamp housing 60. The lamp housing 60 includes a downwardly opening "U" shaped lamp chamber 73 with the base 75 of the lamp chamber 73 having two upwardly extending retaining arms 66 centered on the base 75.

The downwardly opening "U" shaped lamp chamber 73 is closed by a light transmitting lens member or cover schematically shown as 75.

Figure 11:
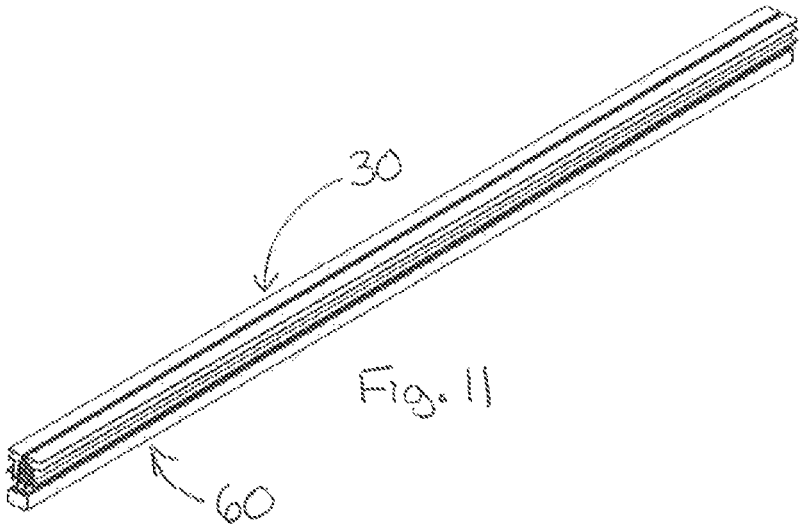
FIG. 11 is a perspective view of a strip light secured to the cross member.

FIGS. 11 and 12 show the modified cross member 30 having the lamp housing 60 secured thereto. As shown in the sectional view of FIG. 12, the lamp housing 60 with the spring clip 50 secured in the securing recess 62 is moved upwardly such that the retaining arms 36 are positioned to go between the spring arms 52 and the adjacent limiting arms 66 of the lamp housing 60. Basically the spring arms 52 may be forced inwardly allowing the retaining arms 36 to pass into the gap and securing projections 37 engage recesses in the spring arms 52 as shown.

It has been found that three spring clips spaced in the length of a lamp housing 60 of a length of approximately four feet is sufficient to securely retain the lamp housing to the grid member however additional spring clips can be provided. The spring clips are placed at appropriate positions in the lamp housing typically when a light strip is made. The locking tabs 54 not only retain the clip in the securing recess 62, they also serve to limit movement of the spring clip in the length of the extruded lamp housing. With the particular cooperation between the modified cross member 30 and the lamp housing 60 the actual lower surface of the light strip is accurately located below the grid. Basically the spring clip 50 bottoms out on the base arms 68 thereby accurately locating the spring clip and the retaining arms 36 with the securing ridges 37 accurately locate within the recesses of the spring clip.

In the embodiment shown, the strip layout has the lower surface thereof slightly below the finished surface of the ceiling. The actual electrical connection of the lamp housing 60 to a power source can be made through the center of the grid by the ports provided in the length of the modified cross member 30. Typically these ports pass through the securing recess 34 and into the space between the limiting arms 66 and to the electrical components secured within the lamp housing. A low voltage power source can be connected above the grid and the lamp selectively connected. The lamp housing 60 with a finished product will include a lens at the bottom of the lamp end caps either end of the lamp housing and may include a suitable connector.

The lighting strip has been described as having a series of LED diodes as the lighting source but other low voltage lighting sources can be used. Heat generated by these sources can be dissipated by conduction to the connected grid system. Additional spring clips can be used if needed.

It can be appreciated that the electrical power supply cables associated with the lamp housing can cooperate with or pass through ports in the modified cross member to gain access to the space above the grid network for electrical connection with a power source.

With this arrangement the low voltage light sources contained within the lamp housing 60 collectively define a finished product and these finished lamp housings can be secured to the grid system after the grid system has been installed. For example, the grid system can be installed with the modified cross members at the desired locations for the strip lighting. As would be common, electricians can then secure as required light fixtures as well as the strip lighting to the exposed grid members. The ceiling panels would then be installed.

T-bar ceiling systems utilize main T members in combination with cross T members that releasably engage the main T-bar members. There are a host of different approaches for connecting of the cross T members to the main T members.

With the lamp housing and the releasable connection of the lamp housing to a cross member, the lamp housing itself can include small projecting flanges for supporting an adjacent edge of a panel. These projecting flanges would be above the lower surface of the housing and be appropriately spaced due to the engagement of the lamp housing of the modified cross member. In this way the lamp housing can be positioned slightly below the finished surface of the cross T ceiling panel system.

It is also possible that the modified cross member could include its own projecting flanges which come down to engage or be positioned adjacent the lower flanges of the main T member. This modified grid member would include a large securing cavity much in the manner of the present system that allows the strip light to be secured to this slightly wider T member.

Various arrangements can be designed to utilize the releasable aspect of the present lamp housing that is sized to cooperate with the ceiling grid system and essentially extends between nodes of the grid system. The advantages of the lamp being capable of being installed to a finished grid system is preferred and allows the grid system to be first installed and then subsequently the electrical fixtures can be installed.

Although various preferred embodiments of the present invention have been described herein in detail, it will be appreciated by those skilled in the art that variations may be made thereto without departing from the appended claims.

The embodiments of the invention in which an exclusive property or privilege is claimed are defined as follows:

1. A ceiling grid system in combination with low voltage strip lights, the ceiling grid system comprising a series of connected grid members for supporting and securing ceiling panels, wherein at least some of the grid members are adapted to support the strip lights and include a pair of opposed downwardly extending retaining arms cooperating to receive and releasably secure one of the low voltage strip lights;

each strip light including an elongate housing having two upwardly extending limiting arms that define a securing recess and a downwardly opening lamp chamber positioned below the securing recess and including a series of light sources spaced along a length of the lamp chamber, the two upwardly extending limiting arms are spaced to receive the downwardly extending retaining arms therebetween, where the upwardly extending limiting arms cooperate such that the downwardly extending retaining arms are received between and respectively contact the upwardly extending limiting arms; and at least two spring clips associated with each pair of opposed downwardly extending retaining arms and the respective securing recess and configured to releasably secure overlapping surfaces thereof, wherein each spring clip includes:

spring arms that releasably engage inward facing surfaces of the downwardly extending retaining arms of the respective grid member, and outwardly extending locking tabs that lock with the upwardly extending limiting arms of the respective strip light to secure the spring clips to the strip light.

2. The ceiling grid system in combination with low voltage strip lights according to claim 1, wherein each of the spring clips is U-shaped.

3. The ceiling grid system in combination with low voltage strip lights according to claim 2, wherein each spring clip includes a base portion, and wherein the spring arms extend upward from the base portion.

4. The ceiling grid system in combination with low voltage strip lights according to claim 1, wherein the upwardly extending arms of the strip lights include outwardly extending heat dissipating heat fins.

5. The ceiling grid system in combination with low voltage strip lights according to claim 1, wherein the inward facing surfaces of the downwardly extending retaining arms of the grid member include securing projections, and wherein the spring arms include undulating surfaces to releasably engage the securing projections.

6. The ceiling grid system in combination with low voltage strip lights according to claim 1, wherein the upwardly extending arms of the strip lights include retaining stub arms, and wherein the outwardly extending locking tabs of the spring clips lock with the retaining stub arms to secure the spring clips to the strip light.

7. A ceiling and lighting system comprising:

a grid member configured to form part of a ceiling grid system for supporting and securing ceiling panels, the grid member including a two downwardly extending retaining arms;

a low voltage strip light including a downwardly opening lamp chamber and two upwardly extending limiting arms that define a securing recess, where the two upwardly extending limiting arms cooperate with the downwardly extending retaining arms of the grid member; and at least one spring clip configured to releasably secure the grid member and the strip light together, each spring clip including:

a base portion configured to lock with the upwardly extending limiting arms of the strip light, and spring arms that releasably engage surfaces of the downwardly extending retaining arms.

8. The ceiling and lighting system according to claim 7, wherein each of the spring clips is U-shaped with the spring arms extending upward from the base portion.

9. The ceiling and lighting system according to claim 7, wherein the downwardly extending retaining arms of the grid member are received between the upwardly extending limiting arms of the strip light.

10. The ceiling and lighting system according to claim 9, wherein the spring arms releasably engage inward facing surfaces of the downwardly extending retaining arms.

11. The ceiling and lighting system according to claim 7, wherein the base portion of each spring clip includes outwardly extending locking tabs that lock with the upwardly extending limiting arms of the strip light.

12. The ceiling and lighting system according to claim 11, wherein the upwardly extending limiting arms of the strip lights include retaining stub arms, and wherein the outwardly extending locking tabs of the spring clips lock with the retaining stub arms.

13. A ceiling grid and lighting system comprising:

a grid member including two downwardly extending retaining arms;

a strip light including an elongate housing having a securing recess on an upper end thereof, the securing recess being defined by a pair of upwardly extending limiting arms and positioned between the upwardly extending limiting arms; and at least one spring clip for releasably securing the strip light beneath the grid member, each spring clip being received in the securing recess of the strip light housing and including two spring arms that respectively engage the retaining arms of the grid member.

14. The ceiling grid and lighting system according to claim 13, wherein each spring clip includes locking tabs that lock the respective spring clip in the securing recess.

15. The ceiling grid and lighting system according to claim 13, wherein a respective retaining stub arm extends from each of the upwardly extending limiting arms of the strip light into the securing recess, the retaining stub arms cooperating with the locking tabs to lock the spring clip in the securing recess.

16. The ceiling grid and lighting system according to claim 13, wherein each of the retaining arms of the grid member fits between a respective one of the spring arms of each spring clip and a respective one of the upwardly extending arms of the strip light.

17. The ceiling grid and lighting system according to claim 13, wherein each of the securement arms of the grid member includes securing projections and each spring arm of the spring clip includes undulating surfaces that engage the respective securing projections to releasably secure the strip light housing to the grid member.

18. A ceiling grid and lighting system comprising:

a grid member including two downwardly extending retaining arms;

a strip light including an elongate housing having a securing recess on an upper end thereof; and at least one spring clip for releasably securing the strip light beneath the grid member, each spring clip being received in the securing recess of the strip light housing and including two spring arms that respectively engage the retaining arms of the grid member, wherein three spring clips releasably secure the strip light housing to the grid member.

19. The ceiling grid and lighting system according to claim 13, wherein the strip light housing includes a series of LEDs therein.

* * * * *